United States Patent [19]

Fenton

[11] Patent Number: 4,551,237

[45] Date of Patent: Nov. 5, 1985

[54] ARSENIC REMOVAL FROM SHALE OILS

[75] Inventor: Donald M. Fenton, Anaheim, Calif.

[73] Assignee: Union Oil Company of California, Los Angeles, Calif.

[21] Appl. No.: 392,161

[22] Filed: Jun. 25, 1982

[51] Int. Cl.[4] ..... C10G 7/00

[52] U.S. Cl. ..... 208/251 R; 208/293

[58] Field of Search ..... 208/251 R, 293

[56] References Cited

U.S. PATENT DOCUMENTS

| | | | |
|---|---|---|---|
| 2,683,683 | 7/1954 | Mills | 208/251 R |
| 2,779,715 | 1/1957 | Murray et al. | 196/50 |
| 2,854,399 | 9/1958 | Weller | 208/88 |
| 2,951,804 | 9/1960 | Juliard | 208/251 R |
| 4,046,674 | 9/1977 | Young | 208/251 |
| 4,083,924 | 4/1978 | Styring | 208/251 R |
| 4,430,206 | 2/1984 | Rankel | 208/251 H |

FOREIGN PATENT DOCUMENTS

| | | | |
|---|---|---|---|
| 0143607 | 12/1978 | Japan | 208/251 R |

OTHER PUBLICATIONS

Evans et al, Semimicro Qualitative Analysis, 1940, p. 53.

*Primary Examiner*—William R. Dixon, Jr.
*Assistant Examiner*—Cynthia A. Prezlock
*Attorney, Agent, or Firm*—Dean Sanford; Gregory F. Wirzbicki; Robert A. Franks

[57] ABSTRACT

Shale oil produced from arsenic-containing oil shale is treated with an aqueous solution of one or more sulfide materials and separated therefrom, yielding an oil fraction of reduced arsenic content. Preferred sulfide materials include ammonium sulfide and ammonium polysulfide.

11 Claims, No Drawings

ARSENIC REMOVAL FROM SHALE OILS

BACKGROUND OF THE INVENTION

1. Field of the Invention

This invention relates to the demetallation of hydrocarbon materials, and more particularly to the removal of arsenic from shale oils.

2. Description of the Art

Vast deposits of oil shale, a sedimentary marlstone, are known to exist in various areas of the world. Such deposits are found in the United States, with the more commercially important materials located in the states of Colorado, Utah and Wyoming. The geologic unit known as the Green River formation in those states contains oil shale having up to about 35 percent by weight of hydrocarbons, in the form of kerogen. Upon heating the shale ("retorting"), kerogen decomposes to produce crude shale oil vapors, which can be condensed into a synthetic crude oil and subsequently introduced into a refinery for conversion to valuable fuels, lubricants and other products.

A number of retorting processes are known, generally classified in two categories: "in situ", wherein shale is heated in chambers formed underground without removing a significant portion of the rock material, and "above ground", wherein shale is mined by conventional methods and transported to a pyrolysis device for heating. The various processes each accomplish separation of solid and liquid retort products, using techniques which are specifically designed for the particular process.

One successful above ground retoring process is shown in U.S. Pat. No. 3,361,644 to Deering, which patent is incorporated herein by reference. In this process, oil shale is fed upwardly through a vertical retort by means of a reciprocating piston. The upwardly moving oil shale continuously exchanges heat with a downwardly flowing high-specific-heat, hydrocarbonaceous recycle gas introduced into the top of the retort at about 1,200° F. In the upper section of the retort (the pyrolysis zone), the hot recycle gas educes hydrogen and hydrocarbonaceous vapors from the oil shale. In the lower section (the preheating zone), the oil shale is preheated to pyrolysis temperatures by exchanging heat with the mixture of recycle gas and educed hydrocarbonaceous vapors plus hydrogen. Most of the heavier hydrocarbons condense in this lower section and are collected at the bottom of the retort as a product oil. The uncondensed gas is then passed through external condensing or demisting means to obtain additional product oil. The remaining gases are then utilized as a product gas, a recycle gas as hereinbefore described, and a fuel gas to heat the recycle gas to the previously specified 1,200° F. temperature.

In all known oil shale retorting processes, arsenic components of the shale either sublime to or are pyrolyzed into vaporous arsenic-containing components. As a result, arsenic in various forms collects with the educed hydrocarbonaceous vapors and condenses with the higher molecular weight hydrocarbons in the preheating zone or, in some processes, in a condenser situated outside of the retorting vessel. When oil shale from the Green River formation is retorted, the concentration of arsenic in the produced crude shale oil is usually in the range of about 30 to 100 parts per million by weight.

Shale oil can be refined to produce valuable fuels, lubricants and the like, using many of the methods known for petroleum processing, such as catalytic cracking, hydrotreating, hydrocracking, reforming and others. Problems arise, however, due to the irreversible poisoning of expensive catalysts used in such processing, caused by the high arsenic content of the oil.

In addition to causing processing difficulties, the arsenic content limits the usefulness of shale oil even in its unrefined state, since burning an arsenic-containing fuel results in unacceptable pollution. For these reasons, it is desirable to reduce the amount of arsenic present in shale oils to the lowest possible level.

Murray et al., in U.S. Pat. No. 2,779,715, describe an arsenic-removing treatment for hydrocarbons, which requires mixing the hydrocarbon with an alkali metal or alkaline earth oxide, hydroxide, or salt which will have a pH above 7 when dissolved in water. Upon separation of the hydrocarbon, it was found to have a reduced arsenic content.

U.S. Pat. No. 2,867,577 to Urban et al. teaches a method for removing arsenic from hydrocarbons by treating with a nitrogen compound, such as ammonia, hydrazine and amines, and separating a hydrocarbon with reduced arsenic content.

Other arsenic removal methods have utilized solid absorbents, such as nickel and molybdenum components deposited on refractory oxides. Examples of such methods are U.S. Pat. Nos. 3,804,750 to Myers et al., 3,876,533 to Myers, and 4,046,674 to Young.

Young, in U.S. Pat. No. 4,075,085, describes a method wherein a hydrocarbon feedstock is mixed with oil-soluble nickel, cobalt or copper-containing additives, heated to at least 300° F., and filtered to remove arsenic. This method has been applied to crude shale oils.

A need remains for a simple, inexpensive method for reducing the arsenic content of shale oils. Such a method would preferably utilize materials which are readily available at locations where crude shale oils are refined.

Accordingly, it is an object of the present invention to provide a method for removing arsenic from shale oil materials.

Another object is to provide an arsenic removal method for shale oil which consumes by-product materials from the refining of the oil.

These and other objects will appear to those skilled in the art, from consideration of the following description and claims.

SUMMARY OF THE INVENTION

In accordance with the present invention, arsenic is removed from shale oil materials by treatment with an aqueous solution of one or more sulfide materials. Sulfide materials which are useful include hydrogen sulfide, alkali metal sulfides and ammonium sulfides. Arsenic removal is facilitated by the use of equipment which permits treatment at elevated temperatures and pressures. Upon separation of the phases obtained during the treatment, a shale oil of reduced arsenic content, an aqueous arsenic-containing solution, and occasionally a small amount of an arsenic-containing solid, are obtained.

DESCRIPTION OF THE INVENTION

Shale oils which can be treated by the method of this invention include those obtained by "in situ" or "above ground" retorting, as well as those produced by chemical extraction techniques, containing at least about 2 parts per million by weight of arsenic. The term "shale oils" is meant to include not only crude shale oil obtained directly from the rock material, but also the products from further treatment or upgrading by such methods as distillation, extraction, de-ashing and the like.

While not being bound to one particular theory, it is considered likely that arsenic is present in raw oil shale mostly as alkaline earth metal arsenates and arsenites and/or as arsenic oxides. During retorting, reactions occur (such as the Bechamp reaction between aromatic amines or phenols and arsenic oxide to form p-amino or p-hydroxyphenylarsonic acids) which cause organoarsenic compounds to form. In addition, a major amount of the arsenic oxides sublimes or volatilizes and dissolves in the condensed shale oil. A portion of the sublimed or volatile arsenic can also be entrained in the shale oil as very small particles, many of which could not be separated by filtration or other ordinary techniques.

In view of the foregoing, the term "arsenic" is considered as including all forms of the element, either uncombined or in organic and inorganic combinations, in which it is present. Also, it should be noted that all feedstock and product oil arsenic concentrations will hereinafter be calculated by weight as elemental arsenic, expressed as parts per million by weight (ppm).

The removal of arsenic from shale oils is carried out using a method which generally comprises treating the shale oil with an aqueous solution of one or more sulfide materials and separating a shale oil of reduced arsenic content. Sulfide materials contemplated for use herein include hydrogen sulfide, and alkali metal and ammonium sulfides (including polysulfides). The treatment gives improved results with elevated temperatures and usually will be conducted at such pressures as will prevent boiling of the aqueous solution at a desired temperature, normally up to about 4,000 p.s.i.a. pressure.

That portion of the total arsenic which is present in shale oils as arsenic oxide is quite soluble in water (approximately 6 to 7 weight percent in boiling water) and has been determined to have a considerable solubility in hot shale oil. For this reason, treatment of the oils by contacting with only water will remove a portion of the arsenic, the exact amount removed depending upon the relative solubilities, ratio of oil and water volumes, number of contact stages, and the like. However, removal of the organically-bound arsenic requires treatment under conditions which can effect the breaking of molecular bonds. For example, if it is assumed that phenylarsonic acids are present from the previously mentioned Bechamp reaction, arsenic could be recovered following a hydrolysis-type reaction to re-form arsenic oxide.

More efficient arsenic removal can be accomplished by converting the arsenic oxide into a form which is more soluble in aqueous media than in the shale oil. Such conversion results from treatment of the oil with sulfide materials, which react with arsenic to form arsenic sulfides and complex anionic species such as thioarsenites and thioarsenates. The treatment will rapidly remove dissolved arsenic from the oil and also remove organically-bound arsenic as it is released from the organic molecules by hydrolysis or other reactions.

Treatment of shale oils by the method of this invention comprises mixing the arsenic-containing oil with sulfide material. Sulfide material typically will be utilized in the form of an aqueous solution except for hydrogen sulfide, which can be introduced as a gas, concurrently with the introduction of water or steam into the mixture.

The method can be conducted either in batch or continuous types of operation. For batch operation, oil and sulfide material are intimately mixed in a suitable vessel, using techniques well known in the art, mixing is discontinued, and the resulting mixture is separated into an organic phase and an aqueous phase containing the removed arsenic. In a continuous operation, oil and sulfide material are passed either concurrently or countercurrently into a reactor, which can be fitted with mixing devices, charged with packing material (such as Raschig rings, ceramic balls, and the like), and/or provided with fractionating means such as bubble plates, sieve plates, etc., and therefrom passed as a mixture into a phase separating means for recovery of product oil and an aqueous effluent.

As previously noted, elevated temperatures facilitate arsenic removal from the oil, probably due to the accelerated decomposition of organoarsenic compounds at higher temperatures. A temperature of at least about 75° C. is desired for the practice of the invention; the maximum useful temperature is not particularly critical, but normally will be below the point at which significant thermal cracking of the oil occurs. It would not normally be necessary to use temperatures above about 375° C. Very efficient arsenic removal has been observed at about 300° C., a temperature which is probably sufficient for breaking the chemical bonds to release organic-bound arsenic. The preferred temperature range, therefore, is from about 150° C. to about 350° C.

A further enhancement of arsenic removal efficiency can be obtained by choosing sulfide materials which have greater oil solubilities, due to the reduced amount of mixing energy which will be required. This factor causes, for example, ammonium sulfide to be preferred over sodium sulfide for use in the invention.

The choice of sulfide materials which remove arsenic also affects subsequent operations in the method. More acidic sulfides, such as hydrogen sulfide or a bisulfide salt, tend to form precipitates of arsenic sulfide which require separation by filtration, centrifugation or similar techniques. Alkaline sulfides, such as ammonium sulfide and ammonium polysulfide, form species such as thioarsenites and thioarsenates which remain water soluble and therefore are more easily separated from the oil. Aqueous solubility of the arsenic is also increased by using more highly concentrated sulfide or polysulfide solutions, which help to prevent the formation of arsenic sulfide precipitates.

When hydrogen sulfide is used in the method, initial pressures of about 0.1 to about 800 p.s.i.g. of the gas can be used, more preferably about 1 to about 400 p.s.i.g., and most preferred as from about 10 to about 100 p.s.i.g.

Solutions of inorganic sulfides which are useful in the method should have a sulfide material concentration in the range of about 0.075 to about 500 grams per liter; a concentration of between about 1 and about 400 grams per liter is more preferred. The absolute amount of sulfide present should be at least about 1.5 times the amount of arsenic present; higher proportions are preferred, up to about 10,000 times as much sulfide as arsenic. Useful volume ratios of aqueous phase to oil phase lie in the range of about 0.01 to about 100, with the preferred ratio being from about 0.05 to about 2.

Some emulsions have been observed to form when shale oils are treated with sulfide materials. While these emulsions are much less stable than those resulting from the treatment of shale oils with agents such as sodium hydroxide, some provision must be made in the arsenic removal facility for emulsion breaking. In its least complex form, this can consist of a large, unagitated vessel (or series of smaller vessels) in which phase disengagement can proceed. More typically, however, one or more emulsion breaking treatments will be utilized. Among those commonly known in the art are adding de-emulsifying agents, centrifuging, cooling, ultrasonic treatment, treating with emulsion absorbents, and others. A specific emulsion breaking technique will be chosen for a particular emulsion, the nature of the emulsion depending upon the shale oil and sulfide material actually used and the conditions under which they are reacted.

Alternatively, when ammonium sulfides are used, emulsions can be broken by allowing ammonia to escape, for example, from the reaction vessel as the oil-water mixture is being discharged. As the pH of the aqueous phase decreases, emulsions will become less stable.

The invention is further illustrated by the following examples, which are illustrative of various aspects of the invention and are not intended as limiting the scope of the invention as defined by the appended claims. In the examples, all percentages are expressed on a weight basis.

EXAMPLE 1

A reaction bomb is fabricated by boring out a steel cylinder to form a recess which will hold a glass tube of about 150 milliliters capacity. The upper portion of the recess is threaded to accept a plug fitted with a gas inlet tube and valve, so that the bomb can be pressurized and then sealed. A well for thermocouple attachment is formed in the metal surrounding the glass tube.

In the experiments described in Table I below, 25 grams of retorted shale oil containing about 50 ppm arsenic are placed in the glass tube of the bomb with the desired treating reagent, the bomb is plugged, and gas (if used in that particular experiment) is added to obtain the indicated gauge pressure. The sealed bomb is heated to a desired temperature, maintained for an indicated time at that temperature, and then allowed to cool to room temperature before being opened for removal of the shale oil product.

TABLE I

| Treatment Number | Reagent | Amount | Temperature, °C. | Time, Hours | Product Arsenic, ppm |
|---|---|---|---|---|---|
| 1 | $H_2S$ | 25 p.s.i. | 100 | 1 | 22 |
| 2 | $H_2S$ | 25 p.s.i. | 100 | 2 | 23 |
| 3 | $H_2S$ | 25 p.s.i. | 200 | 1 | 27 |
| 4 | $H_2S$ | 25 p.s.i. | 200 | 2 | 39 |
| 5 | $H_2S$ | 100 p.s.i. | 200 | 1 | 24 |
| 6 | $H_2S$ | 25 p.s.i. | 300 | 1 | 6 |
| 7 | $H_2S$ | 25 p.s.i. | 200 | 4 | 10 |
| | $H_2$ | 75 p.s.i. | | | |
| 8 | $H_2O$ | 90 grams | 200 | 2 | 10 |
| | $H_2S$ | 25 p.s.i. | | | |
| 9 | $H_2O$ | 90 grams | 300 | 1 | 11 |
| | $H_2S$ | 25 p.s.i. | | | |
| 10 | $H_2O$ | 90 grams | 300 | 2 | 16 |
| | $H_2S$ | 25 p.s.i. | | | |
| 11 | $Na_2S$ | 5 grams | 200 | 4 | 4 |
| | $H_2O$ | 100 grams | | | |
| | $N_2$ | 100 p.s.i. | | | |

TABLE I-continued

| Treatment Number | Reagent | Amount | Temperature, °C. | Time, Hours | Product Arsenic, ppm |
|---|---|---|---|---|---|
| 12 | $Na_2S$ | 5 grams | 300 | 1 | 2 |
| | $H_2O$ | 100 grams | | | |
| | $N_2$ | 100 p.s.i. | | | |
| 13 | $Na_2S$ | 5 grams | 300 | 2 | 2 |
| | $H_2O$ | 100 grams | | | |
| | $N_2$ | 100 p.s.i. | | | |
| 14 | $Na_2S$ | 5 grams | 300 | 4 | 1 |
| | $H_2O$ | 100 grams | | | |
| | $N_2$ | 100 p.s.i. | | | |
| 15 | NaHS | 5 grams | 200 | 1 | 8 |
| | $H_2O$ | 100 grams | | | |
| | $N_2$ | 100 p.s.i. | | | |
| 16 | $Na_2S$ | 10 grams | 300 | 1 | 3 |
| | $H_2O$ | 100 grams | | | |
| | $H_2$ | 100 p.s.i. | | | |
| 17 | $NH_4OH$ | 5 grams | 200 | 1 | 5 |
| | $H_2O$ | 95 grams | | | |
| | $H_2S$ | 25 p.s.i. | | | |
| 18 | $NH_4OH$ | 15 grams | 200 | 1 | 6 |
| | $H_2O$ | 85 grams | | | |
| | $H_2S$ | 25 p.s.i. | | | |
| 19 | $NH_4OH$ | 50 grams | 200 | 1 | 4 |
| | $H_2O$ | 50 grams | | | |
| | $H_2S$ | 25 p.s.i. | | | |
| 20 | $NH_4OH$ | 15 grams | 300 | 1 | 4 |
| | $H_2O$ | 85 grams | | | |
| | $H_2S$ | 100 p.s.i. | | | |
| 21 | $(NH_4)_2S$ | 0.05 grams | 300 | 1 | 16 |
| | $H_2O$ | 0.95 grams | | | |
| | $N_2$ | 100 p.s.i. | | | |
| 22 | $(NH_4)_2S$ | 4 grams | 200 | 1 | 8 |
| | $H_2O$ | 16 grams | | | |
| | $N_2$ | 100 p.s.i. | | | |
| 23 | $(NH_4)_2S$ | 4 grams | 300 | 1 | 1 |
| | $H_2O$ | 16 grams | | | |
| | $N_2$ | 100 p.s.i. | | | |
| 24 | $(NH_4)_2S_2$ | 4 grams | 200 | 1 | 1 |
| | $H_2O$ | 16 grams | | | |
| | $N_2$ | 100 p.s.i. | | | |
| 25 | $NH_4HS$ | 8 grams | 300 | 1 | 3 |
| | $H_2O$ | 12 grams | | | |
| | $N_2$ | 100 p.s.i. | | | |
| 26 | $(NH_4)_2S$ | 4 grams | 300 | 1 | 6 |
| | $H_2O$ | 16 grams | | | |
| | $H_2S$ | 100 p.s.i. | | | |

It should be noted that the reagent formulae in Table I do not include hydration water present in the compounds. The formula $Na_2S$ actually represents the compound $Na_2S.9H_2O$, and NaHS is actually $NaHS.3H_2O$. The formula $(NH_4)_2S_2$ indicates use of a dark ammonium sulfide solution. The $NH_4OH$ is a concentrated solution of about 29 percent by weight ammonia in water.

These results show that a variety of sulfide materials, under a considerable range of treatment conditions, are useful for arsenic removal from shale oil.

EXAMPLE 2

The effect of aqueous to oil volume ratio is demonstrated using the equipment and procedure of the preceding example. Measured quantities of shale oil and either water or 20 percent aqueous solutions of ammonium sulfide are placed in the tube of a bomb. The bomb is pressurized with gas and heated to a predetermined temperature. After a prescribed time, the bomb is allowed to cool to room temperature and the shale oil is recovered for analysis. Results are obtained as in Table II.

TABLE II

| Aqueous Material | Aqueous To Oil Ratio | Gas, Pressure | Temp. °C. | Time, Hours | Product Arsenic, ppm |
|---|---|---|---|---|---|
| $H_2O$ | 0.08 | $H_2S$, 25 p.s.i. | 300 | 2 | 23 |
| " | 0.50 | " | " | " | 4 |
| " | 1.0 | " | " | " | 4 |
| " | 2.0 | " | " | " | 7 |
| $(NH_4)_2S$ | 0.04 | $N_2$, 100 p.s.i. | 300 | 1 | 16 |
| " | 0.27 | " | " | " | 1 |
| " | 0.8 | " | " | " | 1 |

The data are for unstirred samples; mixing the aqueous and oil phases or providing a multi-stage contact will serve to lessen the volume of aqueous material needed to remove arsenic from a given quantity of shale oil in a given period of time.

EXAMPLE 3

When the experiments of Example 1 are repeated using a stirred autoclave in place of the reaction bomb, the results of Table III are obtained for 100 milliliter (mL) sample of shale oil. The ammonium sulfide is an aqueous solution, having the indicated concentration.

TABLE III

| Treatment Number | Reagent | Amount | Temperature, °C. | Time, Minutes | Product Arsenic, ppm |
|---|---|---|---|---|---|
| 1 | 20%$(NH_4)_2S$ | 100 mL | 250 | 15 | 25 |
| 2 | 20%$(NH_4)_2S$ | 100 mL | 315 | 15 | 15 |
| 3 | 20%$(NH_4)_2S$ | 100 mL | 315 | 15 | 10 |
| 4 | 20%$(NH_4)_2S$ | 100 mL | 315 | 60 | 5 |
| 5 | 20%$(NH_4)_2S$ | 100 mL | 250 | 15 | 9 |
| 6 | 20%$(NH_4)_2S$ | 400 mL | 315 | 15 | 1 |
| 7 | $Na_2S.9H_2O$ | 20 grams | 315 | 15 | 4 |
| | $H_2O$ | 400 mL | | | |
| 8 | $Na_2S.9H_2O$ | 30 grams | 315 | 15 | 3 |
| | $H_2O$ | 400 mL | | | |

EXAMPLE 4

Arsenic removal is studied using a continuous-flow reactor filled with about 800 mL of alundum balls (0.125 inch diameter). The reactor is operated at a pressure of about 2000 p.s.i.g., with a gas flow of approximately 2 cubic feet per hour. The gas used is either hydrogen or a mixture of 6 volume percent hydrogen sulfide in hydrogen. Shale oil distillate, containing the fraction which boils below 950° F. (arsenic content of 50 ppm), is mixed with aqueous phase (water or 40 percent ammonium bisulfide or sulfide solutions) at the reactor inlet and flows downwardly through the reactor. Oil flow rates of 400 mL per hour correspond to a reactor residence time of about 6 minutes. Results are as shown in Table IV.

TABLE IV

| Test Number | 1 | 2 | 3 | 4 | 5 | 6 |
|---|---|---|---|---|---|---|
| Temperature, °F. | 600 | 500 | 600 | 650 | 600 | 600 |
| Gas | $H_2S$ | $H_2S$ | $H_2$ | $H_2$ | $H_2$ | $H_2$ |
| Oil Flow, mL/hr. | 400 | 400 | 400 | 400 | 200 | 400 |
| Aqueous Phase | $H_2O$ | $H_2O$ | $NH_4HS$ | $NH_4HS$ | $NH_4HS$ | $(NH_4)_2S$ |
| Aqueous flow, mL/hr. | 100 | 100 | 100 | 100 | 100 | 100 |
| Product Arsenic, ppm | 26 | 40 | 15 | 11 | 12 | 5 |

What is claimed is:

1. A method for removing arsenic from shale oil which comprises contacting the oil with a sulfide material in the presence of water and separately recovering an aqueous fraction and an oil fraction of reduced arsenic content.

2. The method defined in claim 1 wherein said sulfide material is selected from the group consisting of hydrogen sulfide, alkali metal sulfides, ammonium sulfides, and mixtures thereof.

3. The method defined in claim 1 wherein said sulfide material is present in an aqueous solution.

4. The method defined in claim 1 wherein said contacting comprises mixing an oil and sulfide material.

5. The method defined in claim 1 wherein said contacting is conducted at temperatures between about 75° C. and about 375° C.

6. The method defined in claim 1 wherein said contacting is conducted at superatmospheric pressures up to about 4,000 p.s.i.a.

7. A method for removing arsenic from shale oil which comprises contacting the oil with an aqueous solution of a sulfide material selected from the group consisting of alkali metal sulfides, ammonium sulfides and mixtures thereof, at a temperature between about 75° C. and about 375° C., and separately recovering an aqueous fraction and an oil fraction of reduced arsenic content.

8. The method defined in claim 7 wherein said contacting is conducted at superatmospheric pressures up to about 4,000 p.s.i.a.

9. The method defined in claim 7 wherein said solution has a concentration between about 1 and about 500 grams per liter and is present in a volume from about 0.01 to about 100 times the volume of oil.

10. The method defined in claim 7 wherein said contacting is conducted at a temperature between about 250° C. and about 350° C.

11. A method for removing arsenic from shale oil which comprises contacting the oil with an aqueous solution comprising at least about 100 grams per liter of a sulfide material selected from the group consisting of ammonium bisulfide, ammonium sulfide, ammonium polysulfide, and mixtures thereof, at a temperature between about 250° C. and about 350° C. and a superatmospheric pressure up to about 4,000 p.s.i.a., and separately recovering an aqueous fraction and an oil fraction of reduced arsenic content.

* * * * *